US006236158B1

(12) United States Patent
Kikuchi

(10) Patent No.: US 6,236,158 B1
(45) Date of Patent: May 22, 2001

(54) FLUORESCENT DISPLAY DEVICE AND CONTROL ELECTRODE THEREFOR

(75) Inventor: Yasuyuki Kikuchi, Mobara (JP)

(73) Assignee: Futaba Denshi Kabushiki Kaisha, Mobara (JP)

( * ) Notice: Subject to any disclaimer, the term of this patent is extended or adjusted under 35 U.S.C. 154(b) by 0 days.

(21) Appl. No.: 09/126,780

(22) Filed: Jul. 31, 1998

(30) Foreign Application Priority Data

Aug. 27, 1997 (JP) ..... 9-231153

(51) Int. Cl.[7] ..... H01J 1/62
(52) U.S. Cl. ..... 313/497; 313/350
(58) Field of Search ..... 313/497, 495, 313/326, 350

(56) References Cited

U.S. PATENT DOCUMENTS 4,908,548 * 3/1990 Mizohata et al. ..... 313/497
5,534,744 * 7/1996 Leroux et al. ..... 313/497 X

* cited by examiner

*Primary Examiner*—Ashok Patel
(74) *Attorney, Agent, or Firm*—Oblon, Spivak, McClelland, Maier & Neustadt, P.C.

(57) ABSTRACT

A fluorescent display device capable of eliminating occurrence of EMI. The fluorescent display device includes a mesh-like control electrode. The control electrode has a mesh pattern made of a wire of 30 to 50 $\mu$m in diameter into a hexagonal shape so that six sides thereof each are 0.4 mm in length. Also, the mesh pattern is formed so as to have an opening ratio of 74.9%. Such construction effectively eliminates such generation of EMI at a band of 350 to 420 MHz as seen in a conventional fluorescent display device.

4 Claims, 3 Drawing Sheets

FLUORESCENT DISPLAY DEVICE AND CONTROL ELECTRODE THEREFOR

BACKGROUND OF THE INVENTION

This invention relates to a fluorescent display device and a control electrode therefor, and more particularly to a fluorescent display device adapted to eliminate occurrence of electromagnetic interference (EMI) and a control electrode therefor.

In general, a fluorescent display device includes an envelope evacuated to a high vacuum, In which filamentary cathodes acting as an electron source, a mesh-like control electrode for accelerating and controlling electrons emitted from the cathodes and anodes for emitting light due to impingement of electrons thereon are arranged. Electrons emitted from the cathodes are permitted to travel through openings of a mesh of the control electrode and then impinge on the anodes, leading to luminescence of a phosphor of each of the anodes.

Currently, such a fluorescent display device as described above is used in a variety of fields while exhibiting characteristics peculiar to a display device of the self-luminescence type. For example, it is widely used as a vehicle mounted display device. Vehicle mounted fluorescent display devices include a fluorescent display device constructed so as to directly display a velocity of a vehicle, a rotational speed thereof and the like on a display panel and that constructed into a light source structure of the type of projecting a display pattern on a front glass of a vehicle to provide a driver with a reflected virtual image thereof. A display system by the latter fluorescent display device of the light source type of providing a driver with the reflected virtual image is called head up display (hereinafter also referred to "HUD"). The vehicle mounted fluorescent display device is generally required to exhibit increased luminance as compared with fluorescent display devices used in other fields in order to permit display to be positively observed. In particular, a fluorescent display device for HUD is required to exhibit luminance of a level 5 times as high as that of the vehicle mounted fluorescent display device because it is required to exhibit satisfactory visibility while overcoming a reduction in quantity of light due to reflection and eliminating affection by light reflected on a road surface.

Now, a conventional fluorescent display device for HUD will be described with reference to FIG. 3.

The fluorescent display device includes an envelope 3 constituted of an anode substrate 1 and a front substrate 2 arranged opposite to the anode substrate 1 while being spaced therefrom at a predetermined interval, as well as a side plate (not shown) arranged between both substrates 1 and 2 so as to extend along an outer periphery of the substrates and sealedly joined thereto. The anode substrate 1 constituting a part of the envelope 3 is formed thereon with wiring conductors 4, which are covered with an insulating layer 5. The insulating layer 5 is formed with through-holes 7 in a manner to positionally correspond to the wiring conductors 4. The through-holes 7 each have a conductive material 8 filled therein. Also, the insulating layer 5 is provided thereon with anode conductors 6 in a manner to positionally correspond to the through-holes 7 or cover the through-holes 7, so that the anode conductors 6 may be connected through the conductive materials 8 in the through-holes 7 to the wiring conductors 4, respectively. The anode conductors 6 each have a phosphor layer 9 deposited thereon, resulting in providing anodes 10. Further, the envelope 3 is provided therein with a mesh-like control electrode 11 in a manner to be positioned above the anodes 10. In addition, the envelope 3 has filamentary cathodes 12 stretchedly arranged therein in a manner to be positioned above the mesh-like control electrodes 11. The filamentary cathodes 12 act as an electron source.

The control electrode 11, as shown in FIG. 4, is constructed into a mesh-like structure which is formed of a wire of 15 to 35 $\mu$m in diameter into a hexagonal shape so that six sides thereof each are 0.25 mm in length.

The fluorescent display device for HUD thus constructed, as described above, is required to exhibit increased luminance, resulting in being typically subject to static drive. On the contrary, dynamic drive of the fluorescent display device may be carried out at a duty ratio one half as large as that in the static drive.

However, operation of the fluorescent display device for display under the conditions that a cathode voltage is set at a rated input, the control electrode is driven at a duty ratio of 1/1 or 1/2 and the anodes are fed with a display signal causes EMI at a band of 350 MHz to 420 MHz to occur in a magnitude of 50 to 80 dB. For example, in the United states, the band is set for military purposes, therefore, the standards concerned define that EMI must be reduced to a level of 15 dB or less. Also in Japan, the standards concerned likewise demand to reduce EMI to a level of 15 dB or less.

The inventors considered that occurrence of such EMI is caused due to BK oscillation. BK oscillation means Barkhausen-Kurtz vibration and indicates electric vibration which occurs when a lattice of a triode is set at a positive voltage and an anode is set at a zero or negative voltage. It would be considered to be due to reciprocation of charges. BK oscillation will be more detailedly described with reference to FIG. 3. When anodes 10 are excited for luminescence or when the cathodes 12, control electrode 11 and anodes 10 each are kept at an ON-state, electrons emitted from the cathodes 12 are permitted to be accelerated through openings of the mesh-like control electrode 11 and then impinged on the anodes. However, when the anodes 10 are not driven or when the cathodes 12 and control electrode each are kept at a ON-state while keeping the anodes 10 at an OFF-state, electrons emitted from the cathodes 12 have nowhere to go and are repelled by the anodes 10, resulting in returning toward the cathodes 12 through the openings of the mesh-like control electrode 11. This would cause vibration of the electrons, leading to generation of a magnetic field, resulting in occurrence of EMI at a fixed frequency band.

SUMMARY OF THE INVENTION

The present invention has been made in view of the foregoing disadvantage of the prior art.

Accordingly, it is an object of the present invention to provide a fluorescent display device which is capable of substantially eliminating generation of EMI.

In accordance with one aspect of the present invention, a fluorescent display device is provided. The fluorescent display device includes an envelope evacuated to a high vacuum, an electron source arranged in the envelope, a mesh-like control electrode arranged in the envelope for controlling electrons emitted from the electron source, and anodes each arranged in the envelope and formed thereon with a phosphor which emits light due to impingement of electrons emitted from the electron source thereon. The mesh-like control electrode is constructed so as to have an opening ratio set to be 70% or more.

In a preferred embodiment of the present invention, the opening ratio is set to be 74.9% or more.

In accordance with another aspect of the present invention, a control electrode for a fluorescent display device including an envelope evacuated to a high vacuum, an electron source arranged in the envelope, and anodes each arranged in the envelope and formed thereon with a phosphor which emits light due to impingement of electrons emitted from the electron source thereon is provided. The control electrode is arranged in the envelope so as to control electrons emitted from the electron source and is constructed into a mesh-like structure which has an opening ratio set to be 70% or more.

In a preferred embodiment of the present invention, the opening ratio is set to be 74.9% or more.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

The inventors considered that an opening ratio of a mesh of a control electrode affects occurrence of EMI on the assumption that occurrence of EMI in a conventional fluorescent display device is due to BK oscillation of electrons in openings of a mesh-like control electrode. Thus, the inventors measured an opening ratio of the control electrode in the conventional fluorescent display device and as a result it was found that the opening ratio was about 70%.

In view of the fact, the inventors made an experiment as to whether EMI occurs in a fluorescent display device while varying an opening ratio of a control electrode over a wide range. As a result, it was confirmed that an opening ratio exceeding about 70% which is an opening ratio in the conventional fluorescent display device permits restraining of EMI and more specifically the opening ratio of 74.9% or more substantially completely prevents occurrence of EMI.

Now, a fluorescent display device according to the present invention will be described hereinafter with reference to FIGS. 1 to 3.

Figure 1:
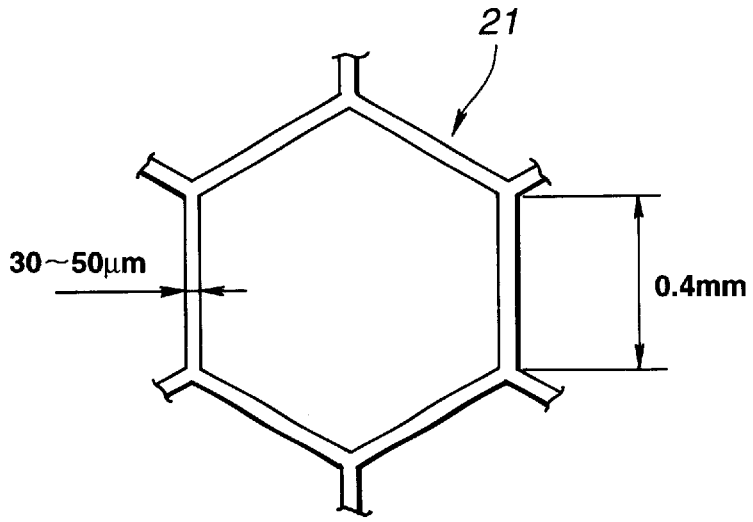
FIG. 1 is an enlarged schematic view showing a mesh pattern of a control electrode incorporated in an embodiment of a fluorescent display device according to the present invention.

Referring first to FIG. 1, a mesh pattern of a control electrode 21 incorporated in an embodiment of a fluorescent display device according to the present invention is illustrated. The mesh pattern is formed of a wire of 30 to 50 $\mu$m in diameter into a hexagonal shape so that six sides thereof each are 0.4 mm in length. Also, in the illustrated embodiment, the mesh pattern is formed so as to have an opening ratio set to be 74.9%. The control electrode 21 may be constructed in substantially the same manner as in the prior art, except the opening ratio of the mesh described above.

Figure 2:
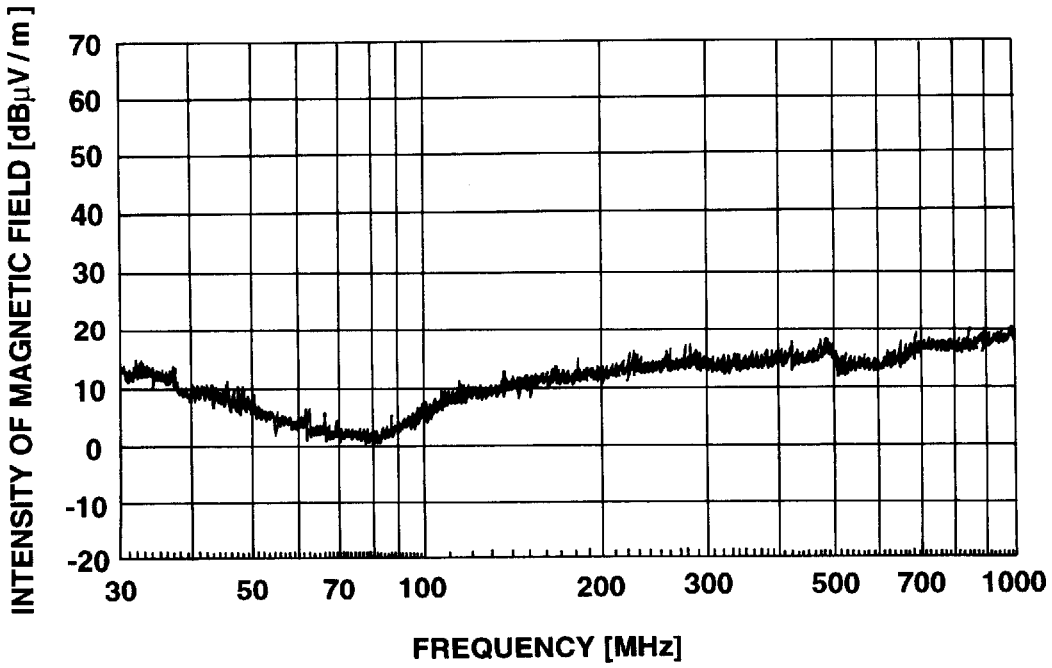
FIG. 2 is a graphical representation showing relationship between a frequency and intensity of a magnetic field in the fluorescent display device of FIG. 1.
Figure 3:
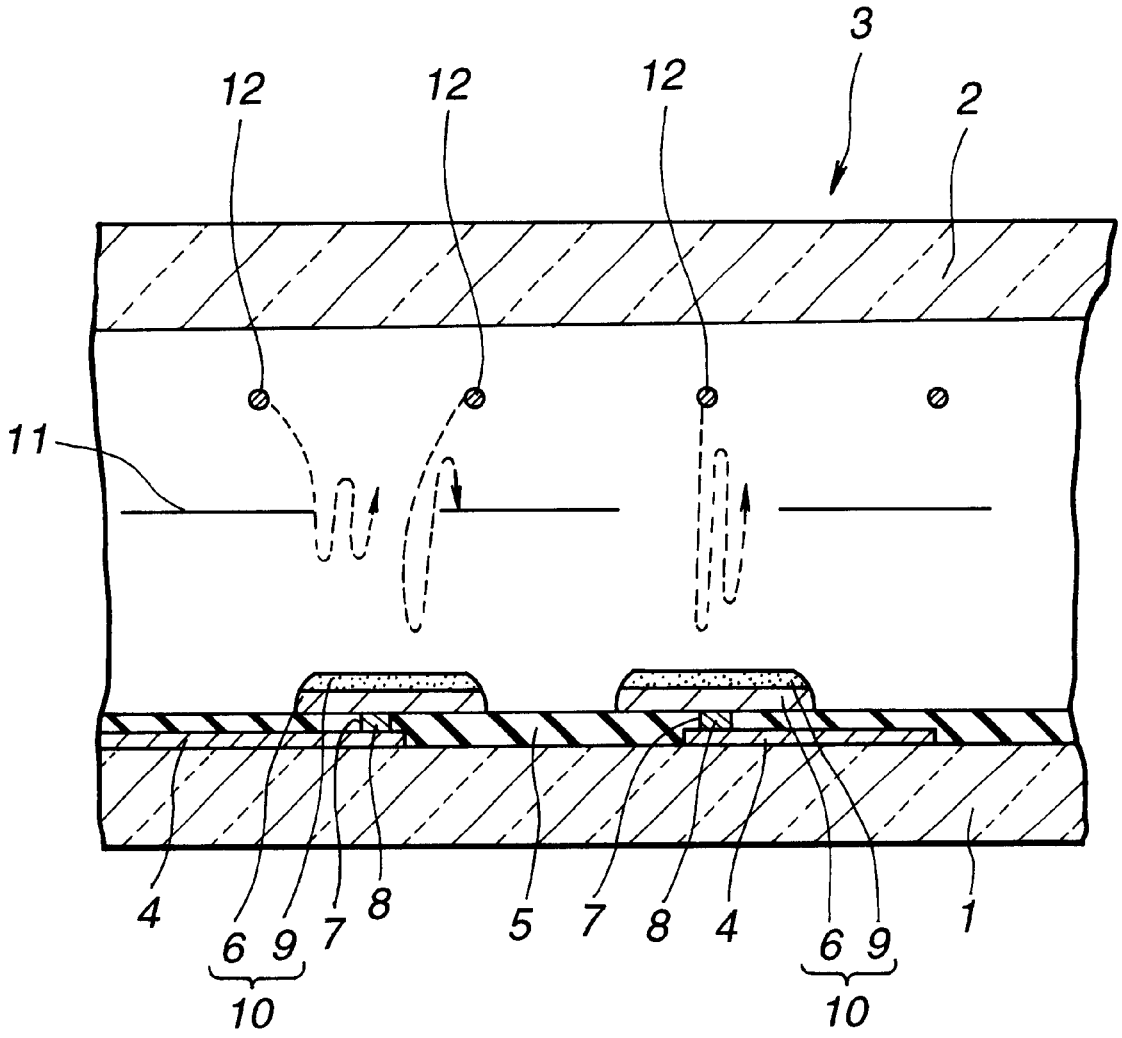
FIG.3 (PRIOR ART)
FIG. 3 is a fragmentary sectional view showing an essential part of a conventional fluorescent display.
Figure 4:
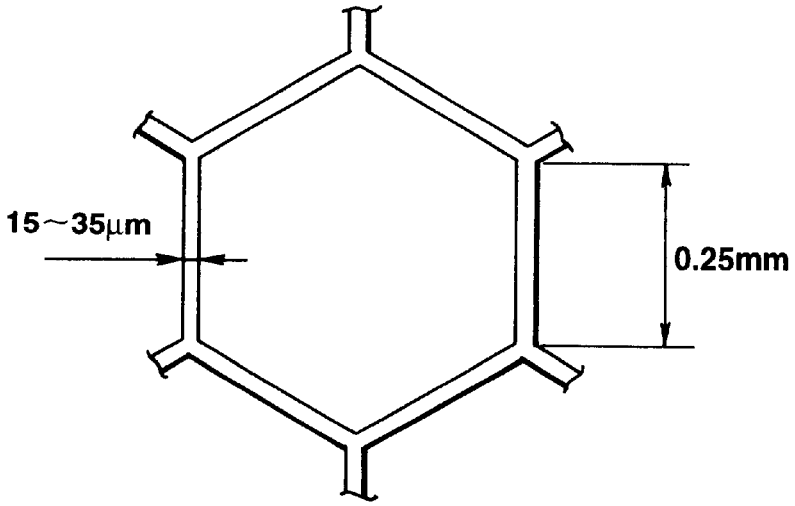
FIG.4 (PRIOR ART)
FIG. 4 is an enlarged schematic view showing a mesh pattern of a control electrode incorporated in a conventional fluorescent display device.
Figure 5:
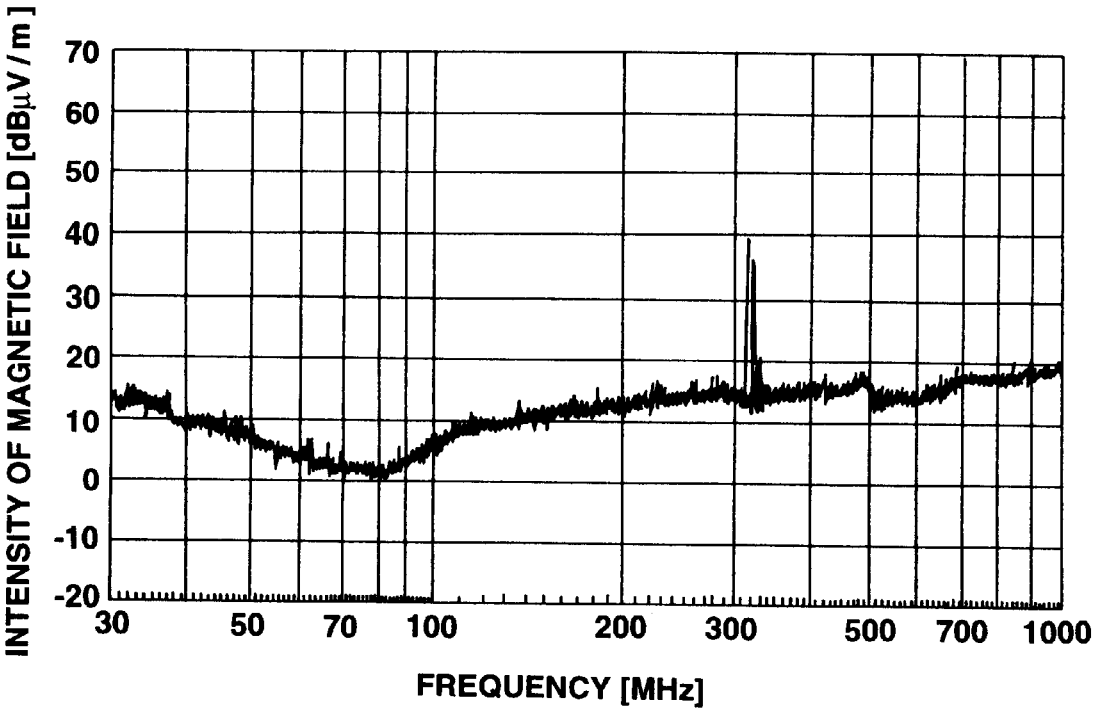
FIG.5 (PRIOR ART)
FIG. 5 is a graphical representation showing relationship between a frequency and intensity of a magnetic field in the conventional fluorescent display device.

FIG. 2 shows relationship between a frequency generated by the fluorescent display device of the illustrated embodiment during lighting operation thereof and intensity of a magnetic field thereof. FIG. 2 indicates that the fluorescent display device of the illustrated embodiment effectively eliminates such generation of EMI at a band of 350 to 420 MHz as seen in the conventional fluorescent display device shown in FIG. 5.

As can be seen from the foregoing, the fluorescent display device of the present invention is so constructed that the mesh-like control electrode is formed into an opening ratio of 70% or more and more specifically 74.9% or more which is larger than that in the prior art. Such construction effectively prevents BK oscillation of electrons in openings of the control electrode, to thereby substantially prevent or minimize occurrence of EMI.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device for use in a head up display comprising:

an envelope evacuated to a high vacuum;

an electron source arranged in said envelope;

a control electrode arranged in said envelope for controlling electrons emitted from said electron source, said control electrode having a hexagonal mesh structure defining plural hexagonal elements each having six sides, each side having a length of at least 0.4 mm; and anodes each arranged in said envelope and formed thereon with a phosphor which emits light due to impingement of electrons emitted from said electron source thereon.

2. A fluorescent display device as defined in claim 1, wherein said control electrode is made of a wire of 30 to 50 $\mu$m in diameter.

3. A control electrode for a fluorescent display device including an envelope evacuated to a high vacuum, an electron source arranged in said envelope, and anodes each arranged in said envelope and formed thereon with a phosphor which emits light due to impingement of electrons emitted from said electron thereon, wherein:

said control electrode having a hexagonal mesh structure and arranged in said envelope so as to control electrons emitted from said electron source; and said hexagonal mesh structure defining plural hexagonal elements each having six sides, each side having a length of at least 0.4 mm.

4. A control electrode as defined in claim 3 wherein said control electrode is made of a wire of 30 to 50 $\mu$m in diameter.

* * * * *